US006240263B1

(12) United States Patent
Watanabe et al.

(10) Patent No.: US 6,240,263 B1
(45) Date of Patent: May 29, 2001

(54) FLICKER SUPPRESSION DEVICE IN ELECTRONIC EQUIPMENT

(75) Inventors: Takahiro Watanabe, Shizuoka-ken; Ryuichiro Maeyama, Yokohama; Naoyuki Yamamoto, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/210,798

(22) Filed: Dec. 15, 1998

(30) Foreign Application Priority Data

Dec. 19, 1997 (JP) ..... 9-351108

(51) Int. Cl.[7] ..... G03G 15/20
(52) U.S. Cl. ..... 399/69; 219/497
(58) Field of Search ..... 399/69, 70; 307/106; 219/216, 497

(56) References Cited

U.S. PATENT DOCUMENTS

| | | | |
|---|---|---|---|
| 4,268,943 | 5/1981 | Watanabe et al. | 29/131 |
| 4,317,270 | 3/1982 | Watanabe et al. | 29/447 |
| 5,532,799 | 7/1996 | Watanabe et al. | 355/245 |
| 5,608,508 | 3/1997 | Kumagai et al. | 399/339 |
| 5,747,213 | 5/1998 | Okado et al. | 430/124 |
| 5,758,228 * | 5/1998 | Hirose et al. | 399/70 |
| 5,811,764 * | 9/1998 | Hirst | 219/497 |
| 5,937,230 * | 8/1999 | Iwase et al. | 399/69 |

FOREIGN PATENT DOCUMENTS

| | | |
|---|---|---|
| 0 811 893 | 12/1997 | (EP) . |
| 0 905 582 | 3/1999 | (EP) . |
| 7-114296 | 5/1995 | (JP) . |
| 9-197895 | 7/1997 | (JP) . |

* cited by examiner

*Primary Examiner*—Joan Pendegrass
(74) *Attorney, Agent, or Firm*—Fitzpatrick, Cella, Harper & Scinto

(57) ABSTRACT

In a standby state capable of forming an image, a period of a drive pulse of a heater in a fixing unit is made longer than that of the drive pulse in an image formation state to decrease the number of ON/OFF times of a fixing heater, thereby decreasing a brightness flicker in an illumination equipment which is connected to a power supply system identical with that of an image formation apparatus for ON/OFF controlling the heater to control temperature of the fixing unit to be at a target temperature.

14 Claims, 10 Drawing Sheets

| HEATER POWER (MAIN/SUB) | TARGET HEATED AND/OR COOLED ENCLOSED TEMP. | MAIN HEATER OFF TIME | SUB HEATER OFF TIME |
|---|---|---|---|
| 500W/500W | 170°C | 6000ms | 6000ms |
| | 180°C | 8000ms | 8000ms |
| | 190°C | 10000ms | 10000ms |
| | 200°C | 12000ms | 12000ms |
| | 210°C | 14000ms | 14000ms |
| 500W/600W | 170°C | 6000ms | 7800ms |
| | 180°C | 8000ms | 10400ms |
| | 190°C | 10000ms | 13000ms |
| | 200°C | 12000ms | 15600ms |
| | 210°C | 14000ms | 18200ms |
| 600W/600W | 170°C | 7800ms | 7800ms |
| | 180°C | 10400ms | 10400ms |
| | 190°C | 13000ms | 13000ms |
| | 200°C | 15600ms | 15600ms |
| | 210°C | 18200ms | 18200ms |

FIG. 7

FLICKER SUPPRESSION DEVICE IN ELECTRONIC EQUIPMENT

BACKGROUND OF THE INVENTION

1. Field of the Invention

The present invention relates to a flicker suppression device in an image record apparatus being an electronic equipment such as a copy machine, a printer or the like having a fixing heater.

2. Related Background Art

In a conventional image record apparatus, for example, in a copy machine having a main heater and a sub heater as fixing heaters, the main heater is lighted (turned on) for, e.g., 240 ms (microsecond) and the sub heater is lighted for, e.g., 160 ms every time a detected temperature of a fixing roller becomes lower than a target temperature.

Since a lighting time of the fixing heater is constant (i.e., not varied) in a standby state and also in a copy-sequence state, the fluctuation of power to be supplied to the fixing heater frequently repeats as shown in FIG. 5. Therefore, voltage change frequently repeats in a power supplying path connected to the fixing heater in the standby state and also in the copy-sequence state. For this reason, a brightness flicker phenomenon is generated in an illumination equipment, a television or the like which is connected to a power supplying system identical with that of the fixing heater. This situation sometimes has brought unpleasant feeling called as a "flicker" for human eyes. It is desirable to decrease the flicker.

SUMMARY OF THE INVENTION

An object of the present invention is to provide flicker suppression device and method which solve the above-described problem and can decrease a brightness flicker in an illumination equipment, a television or the like connected to a power supplying system identical with that of a fixing heater.

Another object of the present invention is to provide the flicker suppression device and method which independently control main and sub heaters to decrease the flicker in an equipment on standby as much as possible.

Still another object of the present invention is to provide the flicker suppression device and method which decrease the flicker by minimizing the number of power change times in the standby state.

Still another object of the present invention is to provide an image formation apparatus and a control method thereof which decrease the flicker by changing each lighting time of the heater according to an operation condition of the image formation apparatus.

Other objects of the present invention will become apparent from the following description based on the accompanying drawings and the appended claims.

BRIEF DESCRIPTION OF THE DRAWINGS

FIG. 7 is a view showing a relation between a heated and/or cooled enclosed temperature and a heater OFF time;

DETAILED DESCRIPTION OF PREFERRED EMBODIMENTS

Hereinafter, the embodiments of the present invention will be described in detail with reference to the accompanying drawings.

Figure 1:
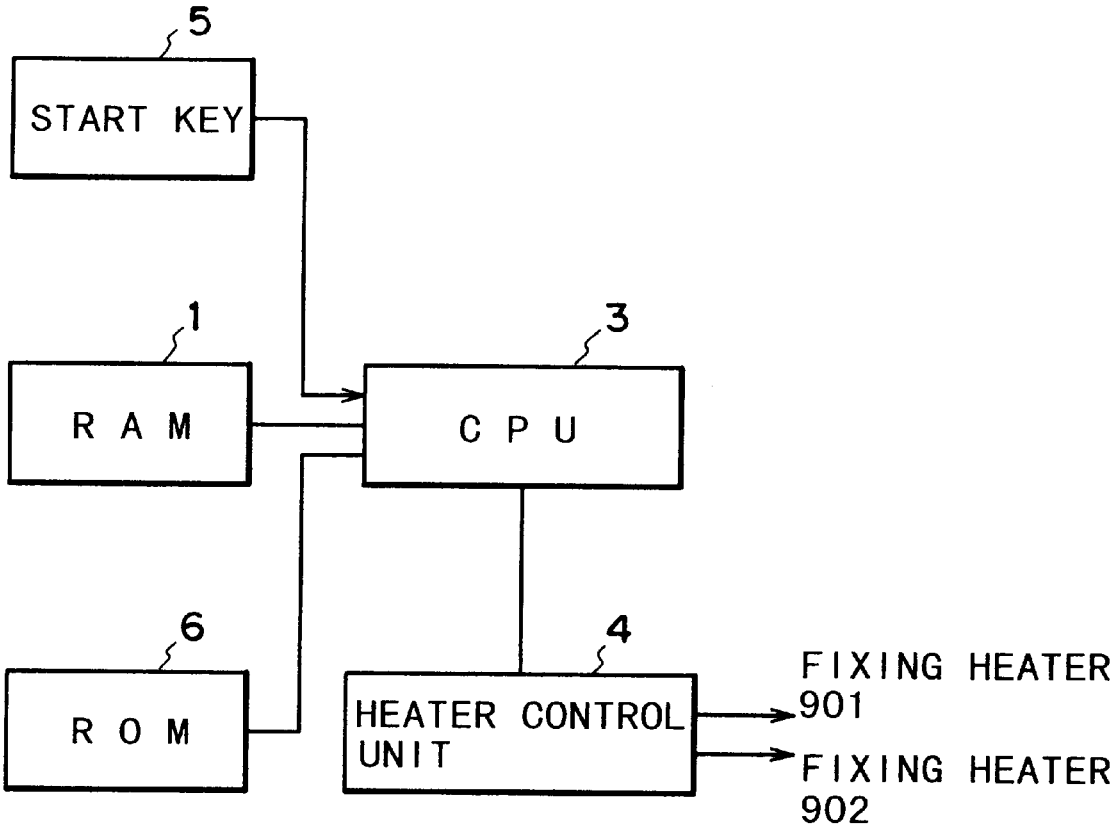
FIG. 1 is a block diagram showing an embodiment of the present invention.
Figure 2:
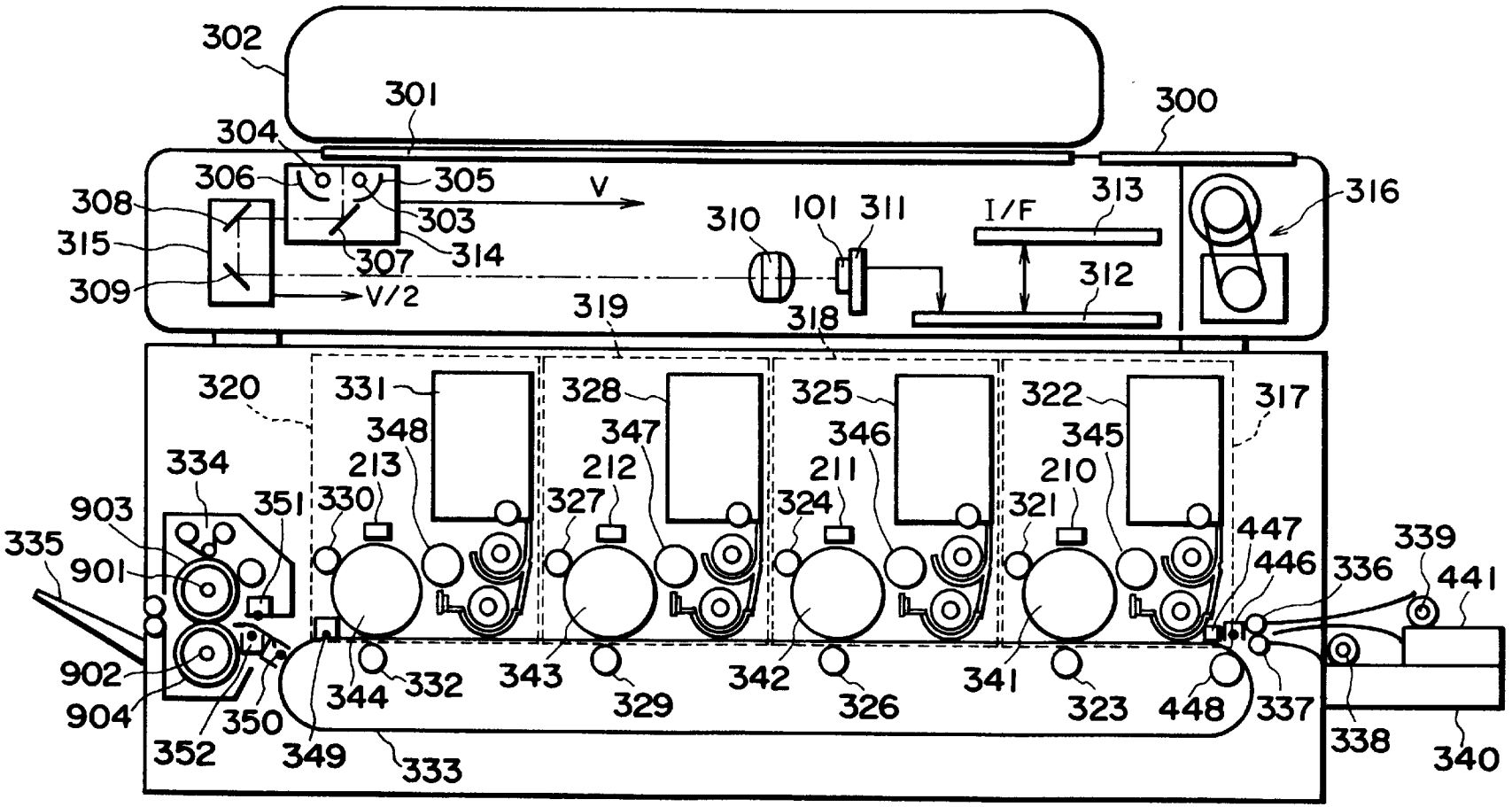
FIG. 2 is a block diagram showing a structure of an image record apparatus.

FIG. 1, which shows a first embodiment of the present invention, indicates an example of a copy machine of which structure is shown in FIG. 2. The copy machine is composed of a reader unit and a printer unit.

Initially, the reader unit will be explained. In FIG. 2, numeral 302 denotes an original feeder (or document feeder: DF) which feeds an original to an original mounting glass (platen) 301. Numerals 303 and 304 denote light sources (halogen lamp or fluorescent lamp) which illuminate the original put on the original mounting glass 301. Numerals 305 and 306 denote reflectors which are used to condense light from the light sources 303 and 304 on the original. Numeral 314 denotes a carriage which holds the halogen lamps 303 and 304, the reflectors 305 and 306 and a mirror 307. Numeral 315 denotes a carriage, which holds mirrors 308 and 309.

Reflection light (transmission light) from the original put on the original mounting glass 301 is guided to a condenser lens 310 by the mirrors 307, 308 and 309 to be guided on a CCD 101 by the condenser lens 310. The CCD 101, which is mounted on a substrate, converts a light signal into an electrical signal. The carriage 314 moves at a speed V in an orthogonal direction to an electrical scan (main scan) direction of the CCD 101 and the carriage 315 moves at a speed V/2, thereby scanning (sub scan) an entire surface of the original. Numeral 312 denotes an image process unit, which performs a drive control of the CCD 101 and processes the obtained electrical signal. Numeral 313 denotes an interface (I/F) unit, which interfaces with an another IPU or the like.

Subsequently, the printer unit will be explained. In FIG. 2, numerals 340 and 441 denotes cassettes, which hold therein recording paper sheets. Numerals 338 and 339 denote pickup rollers, which respectively pick up the sheets one by one from the cassettes 340 and 441. Numerals 336 and 337 denote paper feed rollers, which feed the sheets picked up by the pickup rollers 338 and 339 on a transfer belt 333. Numeral 446 denotes an adsorption charger, which charges the sheets fed by the paper feed rollers 336 and 337 cooperating with a transfer belt roller 448 used for driving the transfer belt 333. Numeral 447 denotes a paper leading edge sensor, which detects a leading edge of the sheet on the transfer belt 333. A detection signal from the paper leading edge sensor 447 is transmitted from the printer unit to a color reader unit, and is used as a sub-scan sync signal when a video signal is transmitted to the printer unit from the color reader unit.

Numeral 317 denotes an M (magenta) image formation unit, 318 denotes a C (cyan) image formation unit, 319 denotes a Y (yellow) image formation unit, and 320 denotes a K (black) image formation unit. These units are arranged opposite to the transfer belt 333 from an upstream side to a downstream side. The M image formation unit 317, the C image formation unit 318, the Y image formation unit 319 and the K image formation unit 320 substantially have the same structure except for colors of development agents used in development units 322, 325, 328 and 331.

The M image formation unit 317 charges a surface of a photosensitive drum 341 up to a predetermined potential by using a primary charger 321 and scans the surface of the photosensitive drum 341 by driving an LED array 210 based on first color image data, after a latent image formation to form a latent image on the surface of the photosensitive drum 341 is prepared. The latent image is developed by the development unit 322 to form an M toner image. The development unit 322 contains a sleeve 345 which is used for performing a development by applying a development bias. The M toner image on the photosensitive drum 341 is to be transferred on the recording paper sheet put on the transfer belt 333 by discharging electricity from a back side of the transfer belt 333 by using a transfer charger 323.

The C image formation unit 318 charges a surface of a photosensitive drum 342 up to a predetermined potential by using a primary charger 324 and scans the surface of the photosensitive drum 342 by driving an LED array 211 based on first color image data, after a latent image formation to form a latent image on the surface of the photosensitive drum 342 is prepared. The latent image is developed by the development unit 325 to form a C toner image. The development unit 325 contains a sleeve 346 which is used for performing a development by applying a development bias. The C toner image on the photosensitive drum 342 is to be transferred on the sheet put on the transfer belt 333 by discharging electricity from the back side of the transfer belt 333 by using a transfer charger 326.

The Y image formation unit 319 charges a surface of a photosensitive drum 343 up to a predetermined potential by using a primary charger 327 and scans the surface of the photosensitive drum 343 by driving an LED array 212 based on first color image data, after a latent image formation to form a latent image on the surface of the photosensitive drum 343 is prepared. The latent image is developed by the development unit 328 to form a Y toner image. The development unit 328 contains a sleeve 347 which is used for performing a development by applying a development bias. The Y toner image on the photosensitive drum 343 is to be transferred on the sheet put on the transfer belt 333 by discharging electricity from the back side of the transfer belt 333 by using a transfer charger 329.

The K image formation unit 320 charges a surface of a photosensitive drum 344 up to a predetermined potential by using a primary charger 330 and scans the surface of the photosensitive drum 344 by driving an LED array 213 based on first color image data, after a latent image formation to form a latent image on the surface of the photosensitive drum 344 is prepared. The latent image is developed by the development unit 331 to form a K toner image. The development unit 331 contains a sleeve 348 which is used for performing a development by applying a development bias. The K toner image on the photosensitive drum 344 is to be transferred on the sheet put on the transfer belt 333 by discharging electricity from the back side of the transfer belt 333 by using a transfer discharger 332.

Numeral 349 denotes a discharge charger, which discharges electricity from the sheet in order to easily separate the sheet, which flows through the K image formation unit 320, from the transfer belt 333. Numeral 350 denotes a separation charger, which prevents an image confusion due to separation discharge when the sheet is separated from the transfer belt 333. Numerals 351 and 352 denote pre-fixing chargers, which charge the sheet separated from the transfer belt 333 to prevent the image confusion by reinforcing adsorption of a toner. Numeral 334 denotes a fixing unit, which thermally fixes a toner image formed on the sheet by heat of rollers 903 and 904 heated by fixing heaters 901 and 902. Numeral 335 denotes a paper discharge tray, which receives discharged sheets.

Subsequently, FIG. 1 will be explained. In FIG. 1, numeral 1 denotes a RAM (random access memory), which stores a heater lighting time setting table. Numeral 6 denotes a ROM (read only memory), which stores a control program. Numeral 3 denotes a CPU (central processing unit), which detects if the copy machine is in a heat-up state, a standby state or a copy operation state according to the control program stored in the ROM 6. A heater lighting time and a heater lighting off time corresponding to the state of the copy machine detected by the CPU 3 or periodicity of a heater drive pulse are captured from the heater lighting time setting table stored in the RAM 1 to set them in a heater control unit 4. Numeral 4 denotes the heater control unit, which controls drives of the fixing heaters 901 and 902 based on the lighting time or the periodicity which is set after capturing it from the RAM 1 by the CPU 3.

Figure 3:
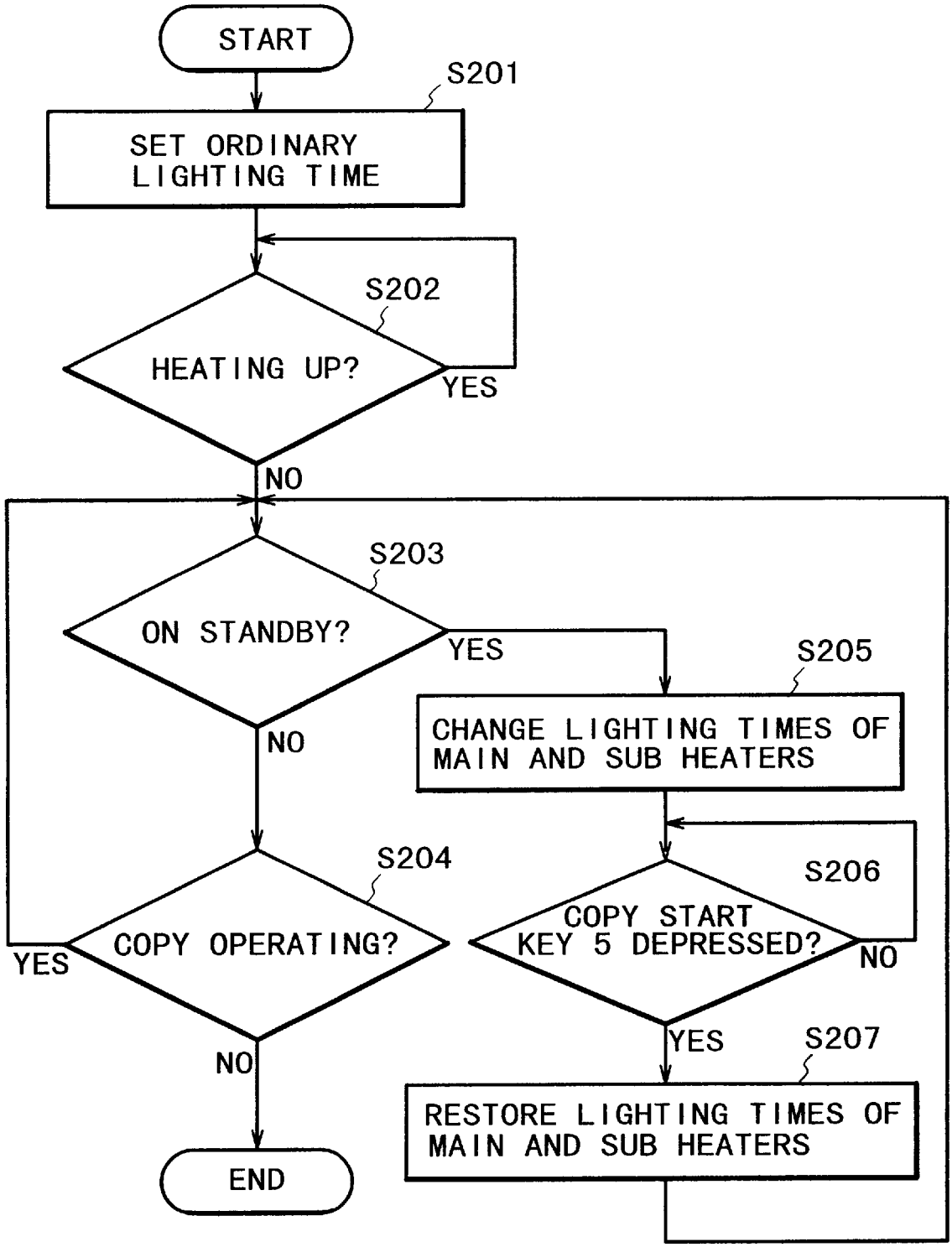
FIG. 3 is a flow chart showing an example of a control program to be stored in a ROM 6 shown in FIG. 1.

FIG. 3 is a flow chart showing an example of the control program stored in the ROM 6 shown in FIG. 1. When the power is supplied, ordinary lighting times of the fixing heaters and periodic data are captured from the RAM 1 to set a time 240 ms as a lighting time of the main heater 901 and a time 160 ms as a lighting time of the sub heater 902 in the heater control unit 4, in a step S201. In a step S202, the heater control unit 4 is caused to execute a heat-up process. A timing is controlled such that the sub heater 902 is not lighted concurrently with the main heater 901.

When a heat-up process by the heater control unit 4 is terminated, a flow advances to a step S203. In the step S203, it is judged whether or not the copy machine ready for copying is in the standby state. If not in the standby state, the flow advances to a step S204. In the step S204, it is judged whether or not the copy machine is in the copy operation state. If in the copy operation state, the flow returns to the step S203. If not in the copy operation state, the control is terminated.

On the other hand, in a case where the judged result in the step S203 indicates the standby state, the flow advances to a step S205. In the step S205, changed lighting times of the fixing heaters and periodic data are captured from the RAM 1 to set a time 7200 ms as the lighting time of the main heater 901 and a time 4800 ms as the lighting time of the sub heater 902 in the heater control unit 4. Then, in a step S206, wait until a copy start key 5 is depressed. In this case, also the timing is controlled such that the sub heater 902 is not lighted concurrently with the main heater 901. When the copy start key 5 is depressed, the flow advances to a step S207. In the step S207, the ordinary lighting times of the fixing heaters and the period data are captured from the RAM 1 to set the time 240 ms as the lighting time of the main heater 901 and the time 160 ms as the lighting time of the sub heater 902. Then the flow returns to the step S203.

Figure 4:
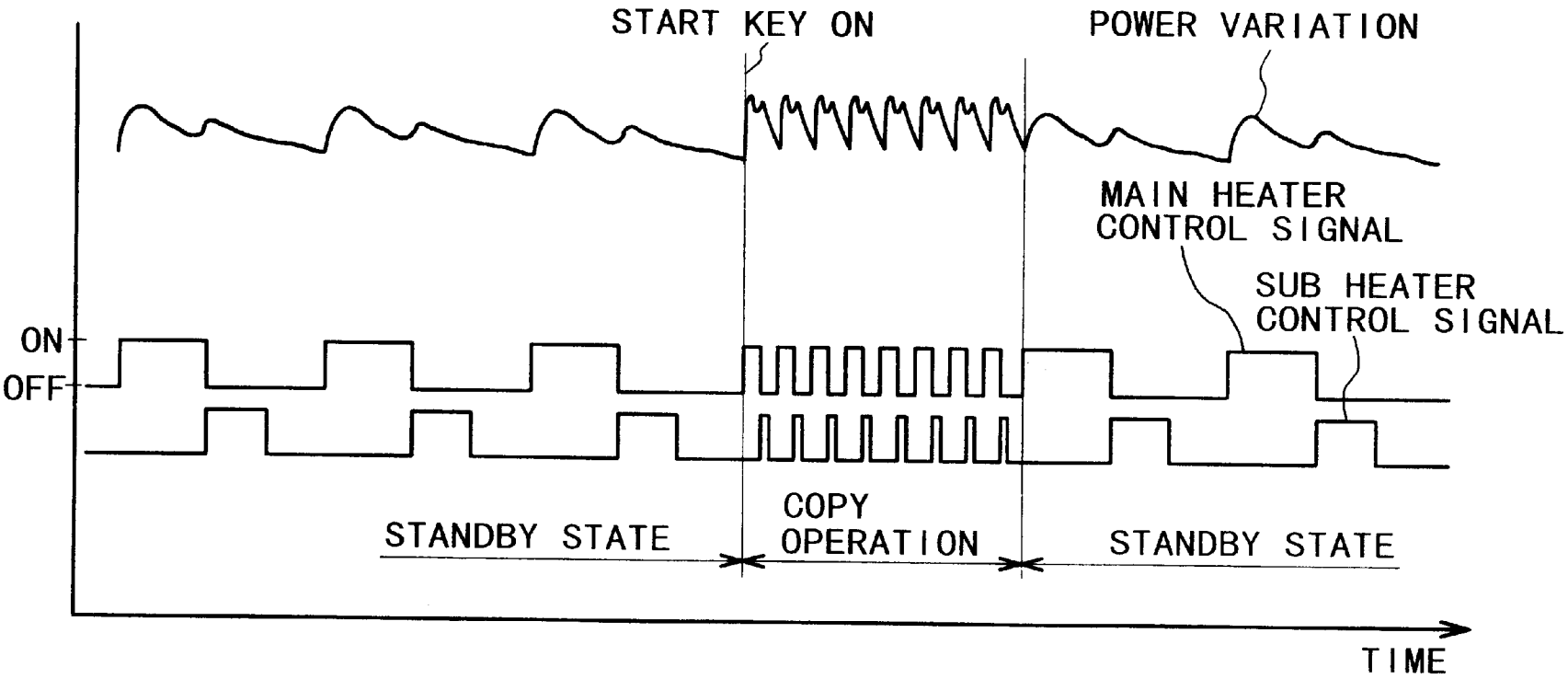
FIG. 4 is a view showing an example of power change for a main heater control signal and a sub heater control signal.
Figure 5:
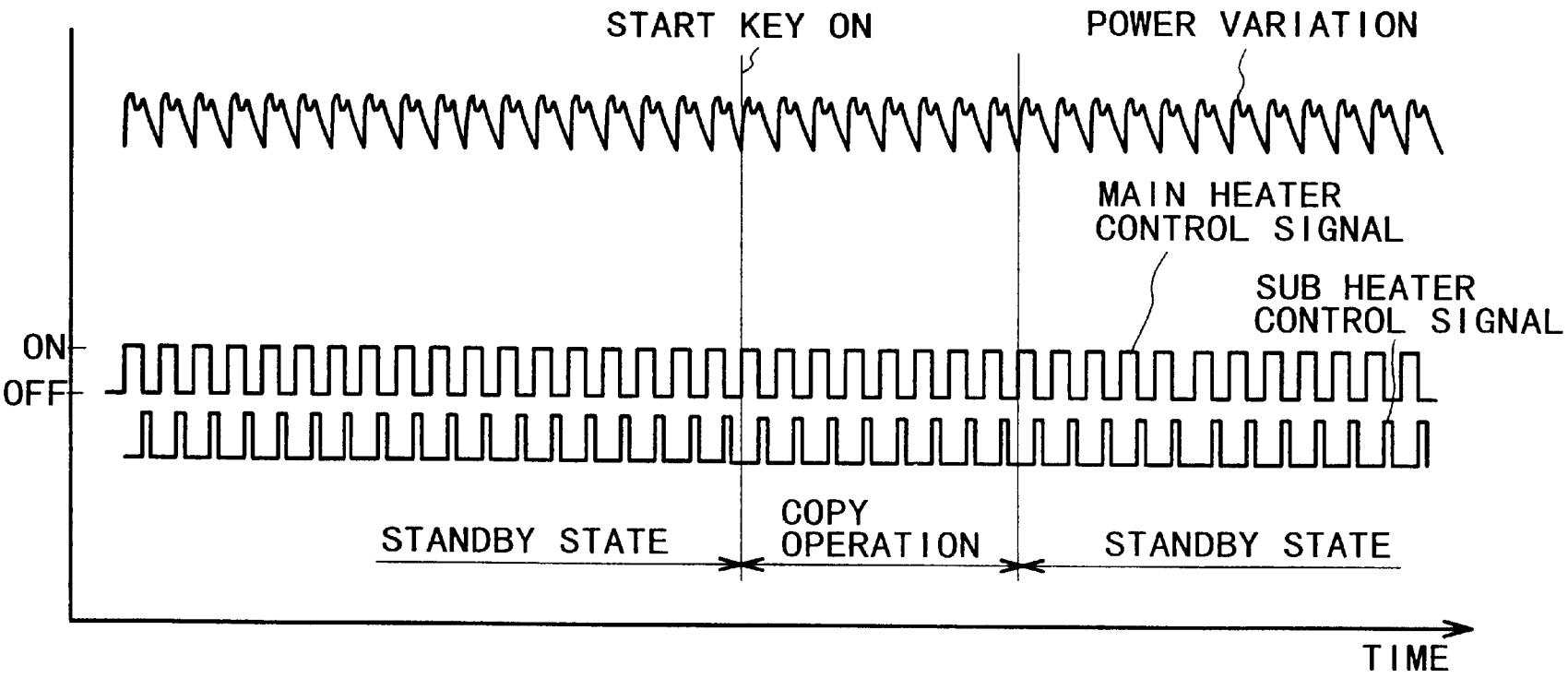
FIG. 5 PRIOR ART
FIG. 5 is a view showing an example of the power change for the main heater control signal and the sub heater control signal in a conventional example.

Since it is not required to precisely perform temperature controls of the fixing heaters in the standby state as compared with the copy operation state, the number of lighting times are to be decreased instead of extending the lighting times of the heaters by performing such a control as the lighting time of the main heater 901 is set the time 7200 ms and the lighting time of the sub heater is set the time 4800 ms in the standby state, as described above. As a result, power changes for a main heater control signal and a sub heater control signal come to be in such a state as shown in FIG. 4. As apparent from FIG. 4, a power change range is decreased and the number of power change times can be considerably decreased. Therefore, an obtained value can clear a flicker standardized value of IEC555-3 (IEC1000-3-3) defining the limits of voltage change and flicker in a commercially available power supply system. The voltage change and flicker occur when electrical loads of an electrical and electronic equipment are switched.

In the first embodiment of the present invention, an example of an image record apparatus having the two fixing heaters is described. However, the same effect as above can be obtained in case of having only one fixing heater.

The number of power change times can be considerably decreased by changing the lighting time of the main heater 901 and the lighting time of the sub heater 902 respectively in an image record operation state and the standby state. Therefore, since the number of power change times in the commercially available power supply system can be decreased, the obtained value can clear the above flicker standardized value.

Figure 10:
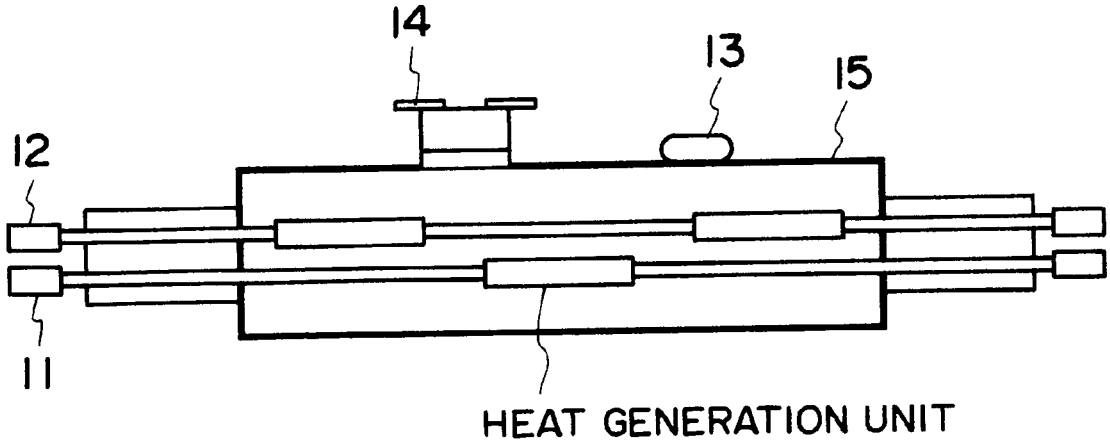
FIG. 10 is a view showing a fixing unit.

FIG. 10 is a cross-sectional view of the fixing unit.

Numeral 11 denotes a main heater, 12 denotes a sub heater, 13 denotes a thermistor, 14 denotes a thermostat, and 15 denotes a fixing roller.

Hereinafter, a second embodiment of the present invention will be described.

Figure 6:
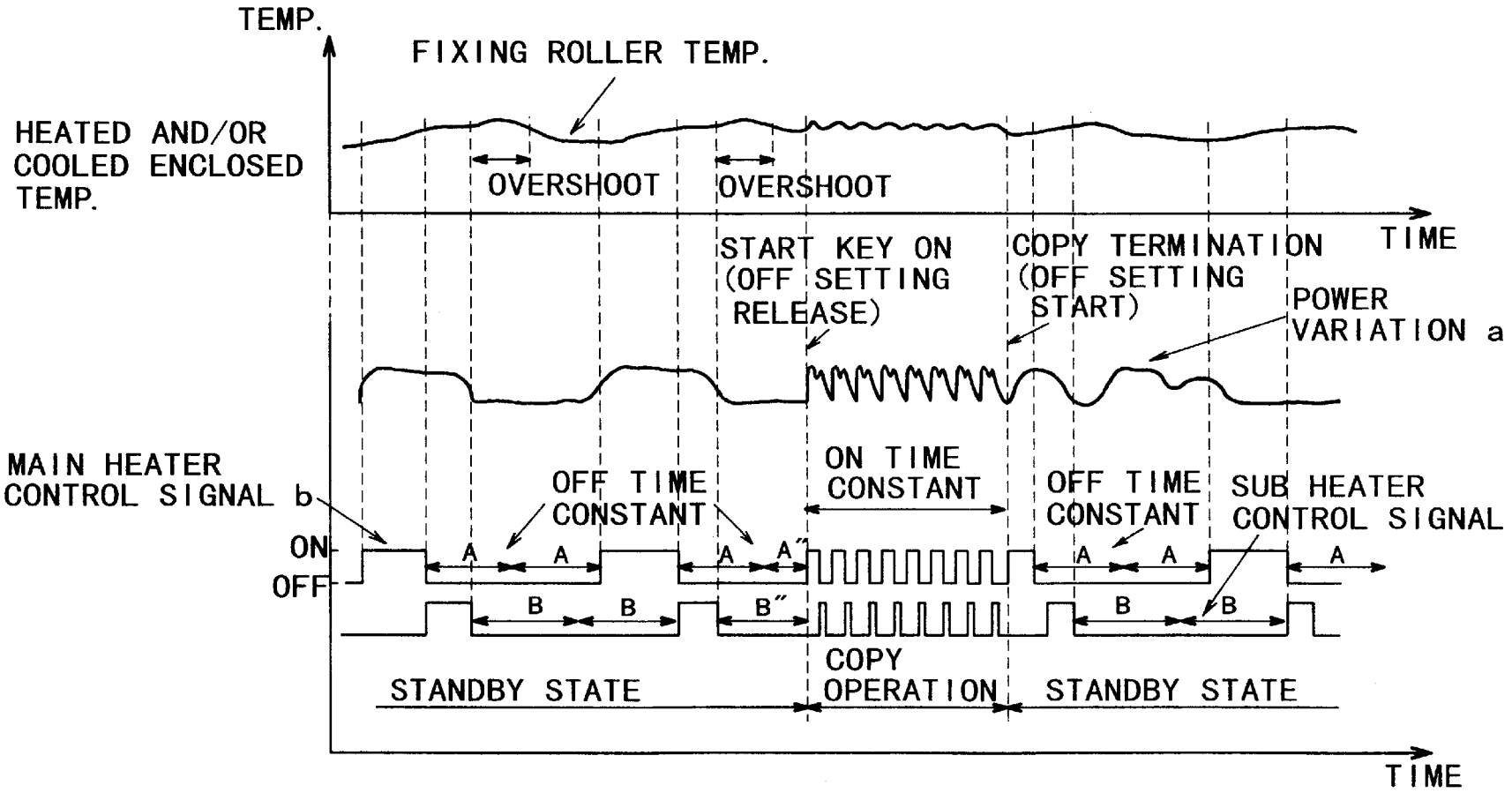
FIG. 6 is a view showing a heater drive condition in a second embodiment.

FIG. 6 indicates a relation among a power variation a in case of controlling an OFF time of a fixing heater according to a sequence, a control signal b of a fixing main heater and a control signal c of a fixing sub heater. Hereinafter, the second embodiment will be explained according to an actual operation.

In the second embodiment, during an image formation apparatus is in a standby state, the OFF time of the fixing heater is set. For example, if a heated and/or cooled enclosed temperature is 190° C., the OFF time of the fixing main heater (500 W) is set 10,000 ms (A in FIG. 6) and the OFF time of the fixing sub heater (600 W) is set 13,000 ms (B in FIG. 6) as shown in FIG. 7. Data corresponding to the OFF time of each heater shown in FIG. 6 is stored in the ROM 6. Since the OFF time of the heater in the standby state is set sufficiently longer as compared with a driving period of the heater in an image formation operation state, entire number of lighting times of the heater can be reduced. If the image formation apparatus is in the standby state, since it is not required that a surface temperature of a fixing roller always reaches the heated and/or cooled enclosed temperature, there occurs no problem in this control. However, if the heated and/or cooled enclosed temperature in the standby state is not maintained at a certain level, heat quantity required in a fixing can not be immediately obtained after depressing a copy start key. Therefore, the OFF time of the fixing heater has to be properly changed according to power of the heater or the heated and/or cooled enclosed temperature as in a characteristic table indicating a relation between the heated and/or cooled enclosed temperature and the OFF time of the heater shown in FIG. 7.

Lighting times of the fixing main heater and the fixing sub heater in the standby state are determined due to the fact that whether or not the temperature reaches the heated and/or cooled enclosed temperature (lighting time is not controlled in this case). That is, when each fixing heater is once lighted, the heater is lighted throughout until it reaches the heated and/or cooled enclosed temperature. If the fixing heater reaches that temperature, the heater is turned off, and the setting OFF time is counted.

As shown in FIG. 6, when a copy is started upon depressing the copy start key during OFF time counting, the OFF time counting is released (A", B").

In this manner, by controlling the OFF time of the fixing heater, the number of lighting times of the heater can be entirely reduced. Therefore, since the number of power change times can be considerably reduced, the obtained value can clear the flicker standardized value.

Since a value of the OFF time in the second embodiment is merely an example, the value can be changed according to another consideration. Further, the same effect as above can be obtained in case of the one fixing heater.

Figure 8:
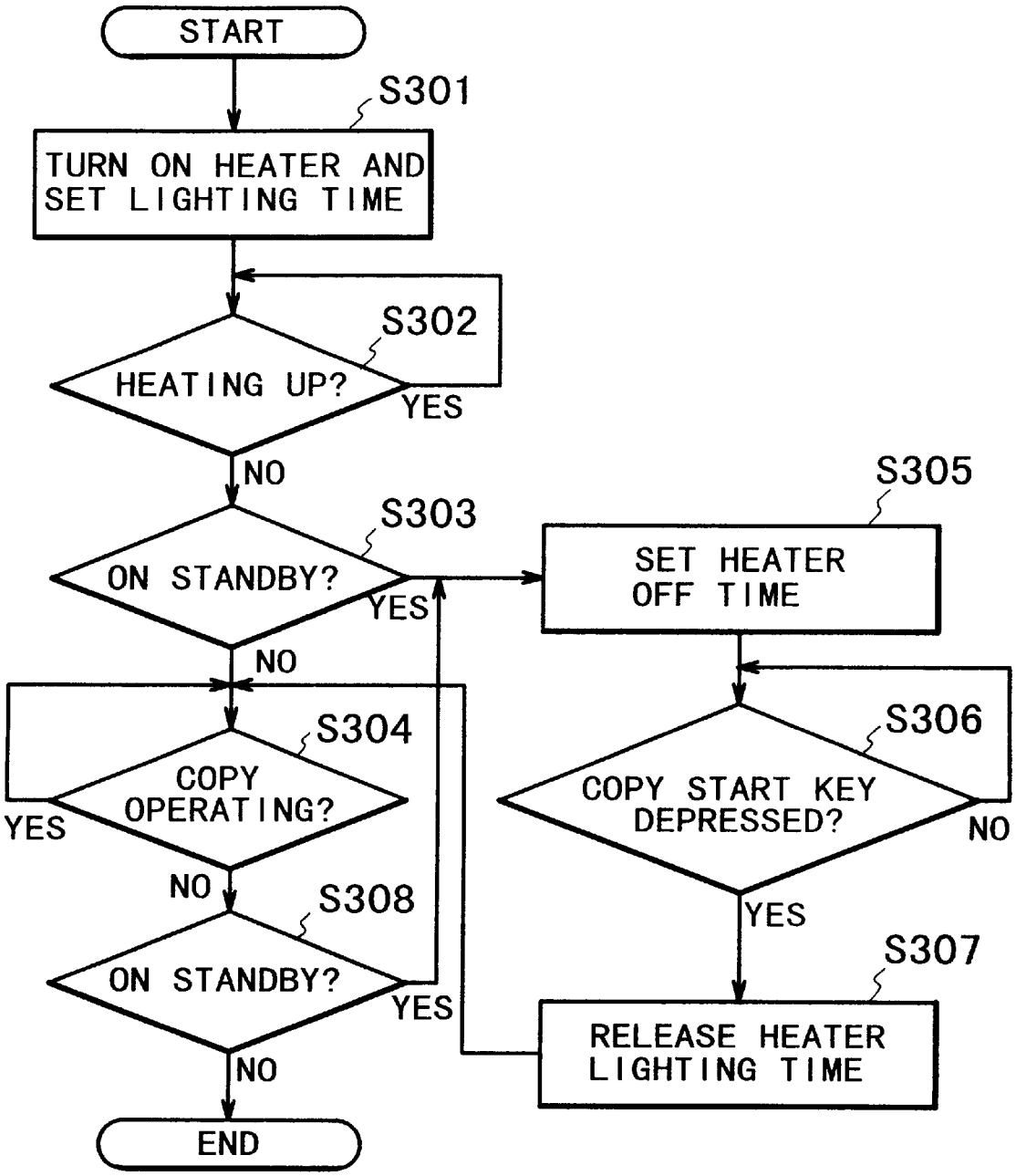
FIG. 8 is a flow chart showing a control operation in the second embodiment.

A control taken measures for the flicker will be described hereinafter with reference to a flow chart shown in FIG. 8.

When the power is supplied in a step S301, the fixing heaters are simultaneously lighted for the purpose of heating up and a lighting time in an ordinary copying state is set. Then, a flow advances to a step S302 to judge whether or not the process of heating up is terminated (reaches heated and/or cooled enclosed temperature). After terminating the process of heating up, the flow advances to a step S303 to judge whether or not the image formation apparatus is in the standby state. If not in the standby state, the flow advances to a step S304. On the other hand, if in the standby state, the flow advances to a step S305. In the step S305, the OFF time of the heater read from the ROM 6 is set, and the flow advances to a step S306. A detailed flow chart at this time will be described later with reference to FIG. 9. In the step S306, it is judged whether or not the copy start key is depressed. If the key is depressed, the flow advances to a step S307. In the step S307, the lighting time of the heater is reset (OFF time setting is released), and the flow advances to the step S304. In the step S304, it is again judged whether or not the apparatus is in a copy operation state. If not in the copy operation state, the flow advances to a step S308 to judge whether or not the apparatus is in the standby state. In the step S308, if in the standby state, the flow advances to the step S305 to perform the control after the step S305 described above. If not in the standby state, the operation is terminated.

Figure 9:
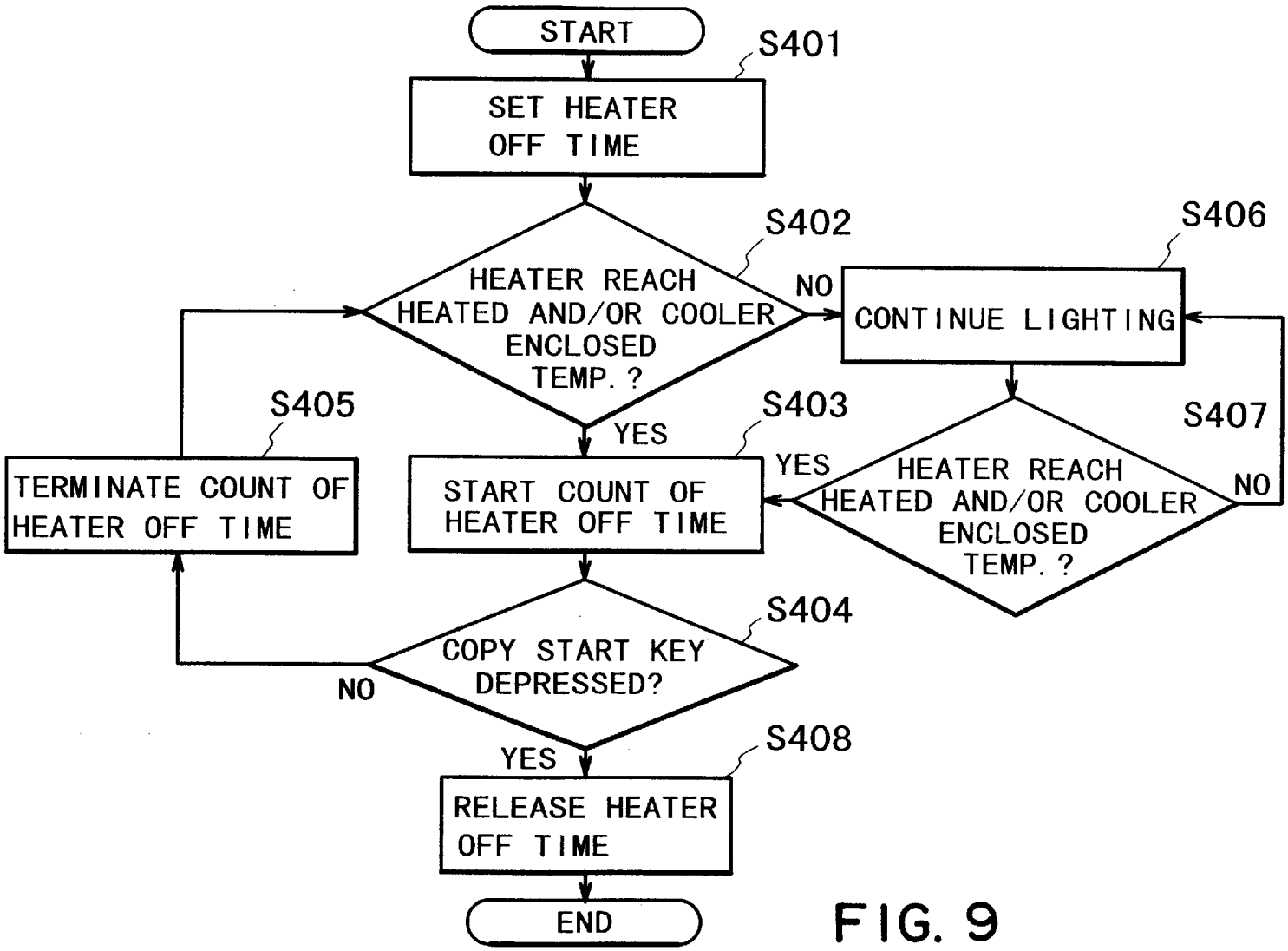
FIG. 9 is a flow chart showing the control operation in the second embodiment.

Subsequently, a control when the OFF time of the heater is set will be described with reference to FIG. 9.

In a step S401, when the OFF times of the main and sub heaters in the standby state are set, a flow advances to a step S402 to judge whether or not the temperature of a fixing unit reaches the heated and/or cooled enclosed temperature. If it reaches the heated and/or cooled enclosed temperature, the flow advances to a step S403. On the other hand, if it does not reach, the flow advances to a step S406. In the step S406, the main heater is lighted to judge whether or not the temperature of the fixing unit reaches the heated and/or cooled enclosed temperature in a step S407. If it reaches the heated and/or cooled enclosed temperature, the flow advances to the step S403. If it does not reach, the main heater is continuously lighted in the step S406. In the step S403, the main heater is turned off and the sub heater is lighted to start to count the OFF time of the main heater set in the step S401. Then, in a step S404, it is judged whether or not the copy start key is depressed. If the key is not depressed, the flow advances to a step S405. In this step, the main heater is forcedly maintained in an OFF state until the count terminates. If the key is depressed, the flow advances to a step S408. In this step, an OFF time set of the heater is released, and then operation terminates. The same control as that of the main heater is performed to the sub heater.

As a result, by the above control, the obtained value can clear the flicker standardized value.

As described above, it is needless to say that the object of the present invention can be also attained when a storage medium storing a program code of software for realizing the function in the above embodiments is supplied to a system or an apparatus, and a computer (CPU or MPU) provided in the system or the apparatus reads the program code stored in the medium and executes it.

In this case, the program code itself read from the storage medium realizes a new function of the present invention, and the storage medium storing therein the program code constitutes the present invention.

As the storage medium for supplying the program code, e.g., a floppy disk, a hard disk, an optical disk, a magneto-optical disk, a CD-ROM (compact disk ROM), a CD-R (compact disk recordable), a magnetic tape, a non-volatile memory card, a ROM (read-only memory), or the like can be used.

It is needless to say that the functions of the above embodiments can be realized not only in the case where the computer reads and executed the program code but also in a case where an OS (operating system) or the like operating on the computer executes a part or all of the actual processes based on instructions of the program code.

Further, it is needless to say that the functions of the above embodiments can be realized also in a case where the program code read from the storage medium is written in a memory provided in a function expansion board inserted in the computer or a function expansion unit connected to the computer, and then on the basis of the instruction of the program code, a CPU or the like provided in the function expansion board or the function expansion unit executes a part or all of the actual processes.

The present invention is not limited to the above embodiments, but can be modified variously within the scope of the appended claims.

What is claimed is:

1. A flicker suppression device in an image formation apparatus, comprising:

a fixing unit having heater elements;

temperature detection means for detecting temperature of said fixing unit; and temperature control means for controlling driving of the heater elements such that when the detected temperature is less than a predetermined temperature, the heater elements is ON during a predetermined period, and when the detected temperature reaches the predetermined temperature at an end of the predetermined period, the heater element is OFF until the detected temperature is less than the predetermined temperature wherein said temperature control means makes the predetermined period in a standby state longer than that in an image formation operation state, so as to decrease the number of power change times in the standby state.

2. A device according to claim 1, wherein said fixing unit has first and second heater elements, and said temperature control means makes the predetermined period in the standby state longer than that in the image formation operation state for each of the first and second heater elements.

3. A flicker suppression device in an image formation apparatus, comprising:

a fixing unit having heater elements;

temperature detection means for detecting temperature of said fixing unit;

a memory storing therein control data representing a predetermined period for each of a standby state and an image formation operating state; and temperature control means for controlling driving of the heater elements such that when the detected temperature is less than a predetermined temperature, the heater element is ON during a predetermined period, and when the detected temperature reaches the predetermined temperature at an end of the predetermined period, the heater element is OFF until the detected temperature is less than the predetermined temperature wherein the predetermined period of the control data in the standby state is longer than that of the control data in the image formation operation state so as to decrease the number of power change times in the standby state.

4. A device according to claim 3, wherein said fixing unit has first and second heater elements, and said temperature control means makes the predetermined period in the standby state longer than that in the image formation operation state for each of the first and second heater elements.

5. A flicker suppression method in an image formation apparatus which comprises a fixing unit having heater elements, a temperature detection means for detecting temperature of the fixing unit, and a memory storing therein control data, said method comprising the steps of:

(a) reading first control data, representing an ON time in a standby state, from the memory when a state becomes the standby state;

(b) driving the heater elements during the predetermined period represented by the first control data read in said step (a) when the detected temperature is less than a first predetermined temperature, and when the detected temperature reaches the first predetermined temperature at an end of the predetermined period, controlling the heater element OFF until the detected temperature is less than the first predetermined temperature;

(c) reading second control data, representing the predetermined period in an image formation state, from the memory after an image forming operation starts; and (d) driving the heater elements during the predetermined period represented by the second control data read in said step (c) when the detected temperature is less than a second predetermined temperature, and when the detected temperature reaches the second predetermined temperature at an end of the predetermined period, controlling the heater element OFF until the detected temperature is less than the second predetermined temperature, wherein the predetermined period in the standby state is longer than that in the image formation state so as to decrease the number of power change times in the standby state.

6. A method according to claim 5, wherein the fixing unit has first and second heater elements, and in said steps (b) and (d) the first and second heater elements are driven according to the control data read for each of the first and second heater elements.

7. A flicker suppression device in an image formation apparatus, comprising:

a fixing unit having heater elements;

temperature detection means for detecting temperature of said fixing unit; and temperature control means for controlling driving of the heater elements such that the temperature detected by said detection means reaches a target temperature, wherein said temperature control means sets an OFF time of the heater elements in a standby state to have a certain constant time longer than that of the heater elements in an image formation operation state so as to decrease the number of power change times in the standby state capable of forming an image, and wherein said temperature control means changes the OFF time of the heater elements according to the target temperature in the standby state.

8. A device according to claim 7, further comprising a memory storing therein data representing the OFF time of the heater elements, and wherein said temperature control means controls driving of the heater elements based on the data read from the memory.

9. A device according to claim 7, wherein said fixing unit has first and second heater elements, and said temperature control means independently sets the OFF time in the standby state for each of the first and second heater elements.

10. A device according to claim 7, wherein said temperature control means releases a setting of the OFF time in the standby state after an image forming operation starts.

11. A flicker suppression method in an image formation apparatus which comprises a fixing unit having heater elements, a temperature detection means for detecting temperature of the fixing unit and a temperature control means for controlling driving of the heater elements such that the temperature detected by the detection means reaches a target temperature, said method comprising the steps of:

(a) judging whether or not the image formation apparatus is in a standby state capable of forming an image;

(b) setting an OFF time of the heater elements in the standby state longer than that of the heater elements in an image formation operation state; and (c) controlling the heater elements on the basis of the set OFF time such that the temperature detected by the detection means reaches a target temperature in the standby state, wherein in said step (b) the OFF time of the heater elements is changed according to the target temperature in the standby state.

12. A method according to claim 11, wherein the image formation apparatus has a memory storing therein data representing the OFF time of the heater elements, and in said step (b) the OFF time is set on the basis of the data read from the memory.

13. A method according to claim 11, wherein the fixing unit has first and second heater elements, and in said step (b) the OFF time in the standby state is independently set for each of the first and second heater elements.

14. A method according to claim 11, further comprising the step of releasing the OFF time set in said step (b) after an image forming operation starts.

* * * * *